United States Patent [19]

Boblit et al.

[11] Patent Number: 4,834,695

[45] Date of Patent: May 30, 1989

[54] AUTOMATIC FOLD-PAN ASSEMBLY

[75] Inventors: Ronald E. Boblit, Sidney; Ronald R. Weiskittle, DeGraff, both of Ohio

[73] Assignee: Baumfolder Corporation, Sidney, Ohio

[21] Appl. No.: 921,260

[22] Filed: Oct. 17, 1986

[51] Int. Cl.[4] ..... B65H 45/14

[52] U.S. Cl. ..... 493/1; 493/23; 493/417; 493/420

[58] Field of Search ..... 493/1, 2, 3, 23, 417, 493/419, 420, 421, 443, 444, 445, 455, 476

[56] References Cited

U.S. PATENT DOCUMENTS

| | | | |
|---|---|---|---|
| 1,581,753 | 4/1926 | Mayer | 493/1 |
| 2,080,505 | 5/1937 | Raper et al. | 493/421 |
| 2,461,214 | 2/1949 | Holms | 493/421 |
| 3,211,448 | 10/1965 | Stoothoff | 493/421 |
| 3,363,897 | 1/1968 | Northern et al. | 493/444 |
| 3,510,122 | 5/1970 | Gavaghan | 493/421 |
| 3,516,665 | 6/1970 | Schmeck | 493/421 |
| 3,692,303 | 9/1972 | Grantham | 493/23 |
| 3,729,186 | 4/1973 | Macke | 493/360 |
| 3,796,423 | 3/1974 | Shuster | 493/421 |
| 3,856,293 | 12/1974 | Boyer | 493/421 |
| 3,943,783 | 3/1976 | Boyer | 74/89.21 |
| 4,099,710 | 7/1978 | Boyer et al. | 493/420 |
| 4,167,265 | 9/1979 | Whittenberger | 493/421 |
| 4,586,704 | 5/1986 | Lehmann et al. | 493/421 |

*Primary Examiner*—Frederick R. Schmidt
*Assistant Examiner*—William E. Terrell

[57] ABSTRACT

An automatic fold-pan assembly for attachment to a sheet folding machine is provided which includes at least one fold-controlling paper stop disposed in the fold-pan assembly in a space between upper and lower plates. The positioning of the paper stop a predetermined distance from the sheet-entrance mouth of the assembly is controlled by a computer in conjunction with stepper motors which are arranged to direct the forward and rearward movement of the paper stop.

4 Claims, 3 Drawing Sheets

AUTOMATIC FOLD-PAN ASSEMBLY

BACKGROUND OF THE INVENTION

This invention relates to buckle-type sheet folding machines and more particularly to an automatic mechanism for adjusting the position of the paper stops in the fold pan of such buckle-type sheet folding machines.

Buckle-type sheet folding machines typically comprise a series of rollers and fold-pan assemblies. A sheet of paper to be folded is inserted between two rotating rollers of a first roller set and is driven by these two rollers into a first fold-pan of a first fold-pan assembly. A forward edge of the sheet eventually strikes a paper stop in the fold pan. However, the two rollers continue to feed the sheet forward. This feeding continues until the sheet buckles, and the bulge of the buckle eventually extends between two rollers of a second roller set. These rollers fold the sheet at the bulge and feed this folded edge into a second fold-pan of a second fold-pan assembly.

Upon striking a second paper stop, there is a new buckle formed in the sheet and this buckle is, in turn, inserted between two rollers of a third roller set. This process continues until the sheet is folded a desired number of times. A typical folding machine may fold a sheet several times. In most buckle-type folding machines, the paper stops in the fold-pan assemblies are adjustable so that the positions of the folds on the paper sheets can be controlled. An example of such a fold-pan assembly is taught in Boyer, U.S. Pat. No. 3,856,293.

However, problems exist in prior art sheet folding apparatuses. In many such apparatuses, it is difficult to adjust accurately the positions of the paper stops. Some adjustments on the fold-pan assemblies are difficult to get to because of the position of the fold-pan assembly within the folding machine. Moreover, skilled operators are required because of the complexity of setting up the pan-fold assemblies from job to job.

Another problem which exists in the art is the need to make folds on sheets which are perpendicular or parallel with the printed matter on such sheets. Normally, paper stops on the fold-pan assemblies are perpendicular with the longitudinal axes of the fold-pans so that the sheet edges registered by paper stops are also perpendicular with longitudinal axes of the fold-pans. the resulting folds of such sheets are parallel with these registered edges. However, it is often the case that printed material on the sheets is not perpendicular or parallel with the sheets edges. Some printing on the sheets may be skewed slightly. Therefore, it is sometimes desirable to cause these sheets to register at slight angles relative to the fold-pan's longitudinal axes so that the folds may be made square with the printed material. In prior art devices, such skewing is difficult to accomplish.

Finally, yet another problem with prior art fold-pan assemblies is that they have no provision to handling sheet material having tabs extending therefrom. Such tabbed sheet material could previously be folded only by the use of special folding machines and, typically, could not be folded in prior art fold-pan assemblies.

Accordingly, the need still exists in the art to provide a fold-pan assembly which can be adjusted readily and rapidly by relatively inexperienced operators and which can be adjusted both for skewed printing and for tabbed sheet material.

SUMMARY OF THE INVENTION

The present invention meets that need by providing an automatic fold-pan assembly for attachment to a sheet folding machine. The automatic fold-pan assembly of the present invention includes at least one upper plate and at least one lower plate defining a space therebetween and having a sheet-entrance mouth at one end thereof. At least one fold-controlling paper stop is disposed in that space and is movable toward and away from the sheet-entrance mouth. Means for positioning the paper stop are provided so that the paper stop may be positioned a pre-determined distance from the sheet-entrance mouth. The positioning means include control means for automatically determining the desired position of the paper stop relative to the sheet-entrance mouth and drive means responsive to the control means for moving the paper stop to the desired position.

In a preferred embodiment of the invention, the control means includes a specially programmed general purpose computer which controls a drive means which automatically positions the paper stop in the desired position. The drive means for the fold-pan assembly preferably includes a stepper motor with a drive belt connecting the stepper motor to the paper stop. Preferably, the computer is programmed to control simultaneously a multiplicity of fold-pan assemblies in a folding machine.

In a preferred embodiment of the invention, a plurality of paper stops are spaced across the upper and lower plates with the stops being interconnected so that they move in unison toward and away from the sheet-entrance mouth. The paper stops may be interconnected by a suitable means such as a bar assembly which is arranged transversely across the upper plate.

To control the plurality of paper stops, the apparatus of the present invention may include dual stepper motors with each individual stepper motor driving opposite ends of the bar assembly. Thus, the computer individually controls the operation of the stepper motors to bias the bar assembly to compensate for printed sheets having printing thereon which is skewed from either a normal or parallel relationship to the edge of the printed sheet.

In operation, the computer control initializes the position of the paper stops upon each start-up of the automatic fold-pan assembly. Preferably, limit switches are positioned on the assembly to detect the end of travel of the paper stops during initialization. This provides the computer with position location information which can be utilized to drive the paper stops into their proper position.

Additionally, the paper stops of the present invention have curved surfaces facing the sheet-entrance mouth. These curved surfaces can act as sheet deflectors when the paper stops are positioned substantially at the sheet-entrance mouth. Such positioning is desirable when only some of the fold-pan assemblies in the folding machine need to be utilized for a particular job. The curved surface of the paper stops acts to cause the paper to follow the track of the rollers in the folding machine and to deflect the paper sheets away from the sheet-mouth entrance.

Finally, one or more of the paper stops in the fold-pan assembly may be removed to accomodate the folding of sheets having tabs extending therefrom. This permits the tabs to be inserted further into the assembly and yet not interfere with the folding of the sheet.

Accordingly, it is an object of the present invention to provide an automatic fold-pan assembly which is easily positioned and adjustable and which eliminates the problems of the prior art. This and other objects and advantages of the present invention will become apparent from the following detailed description, the accompanying drawings, and the appended claims.

DETAILED DESCRIPTION OF THE PREFERRED EMBODIMENTS

Figure 1:
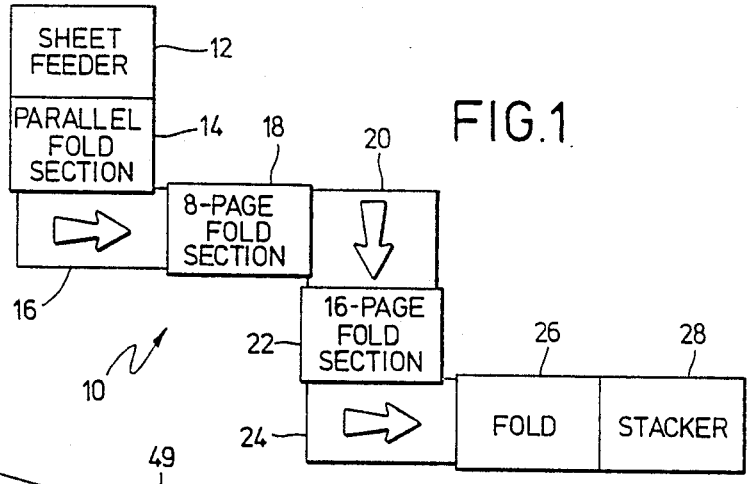
FIG. 1 is a schematic view of a buckle-type sheet folding machine having several sheet folding sections.

Referring now to FIG. 1, there is shown in schematic form a multi-section sheet folding machine 10 in which a sheet is fed through several folders, with each folder section being positioned at right angles to a preceding fold section. It will be apparent to those skilled in the art that individual fold sections can be arranged in either a tandem configuration or at right angles to one another.

In operation, sheets are sequentially fed from a stack and sheet feeder 12 into a first buckle fold parallel fold section 14. After a fold is made in a sheet fold section 14, the sheet is ejected to a conveyor 16 which carries the folded sheet in the direction indicated by the arrow to a second buckle fold section 18. This section is referred to by those skilled in the art as an 8-page fold section because the sheet folded once in each of the first two fold sections can be trimmed to provide an 8-page leaflet.

From the 8-page fold section 18, the sheet is carried by a conveyor 20 to a 16-page fold section 22. Finally, the sheet is carried by conveyor 24 to a 32-page fold section 26 from which the folded work is fed into a stacker 28. It will be understood by those skilled in the art that each fold section may include several fold-pan assemblies as further described below.

Figure 2:
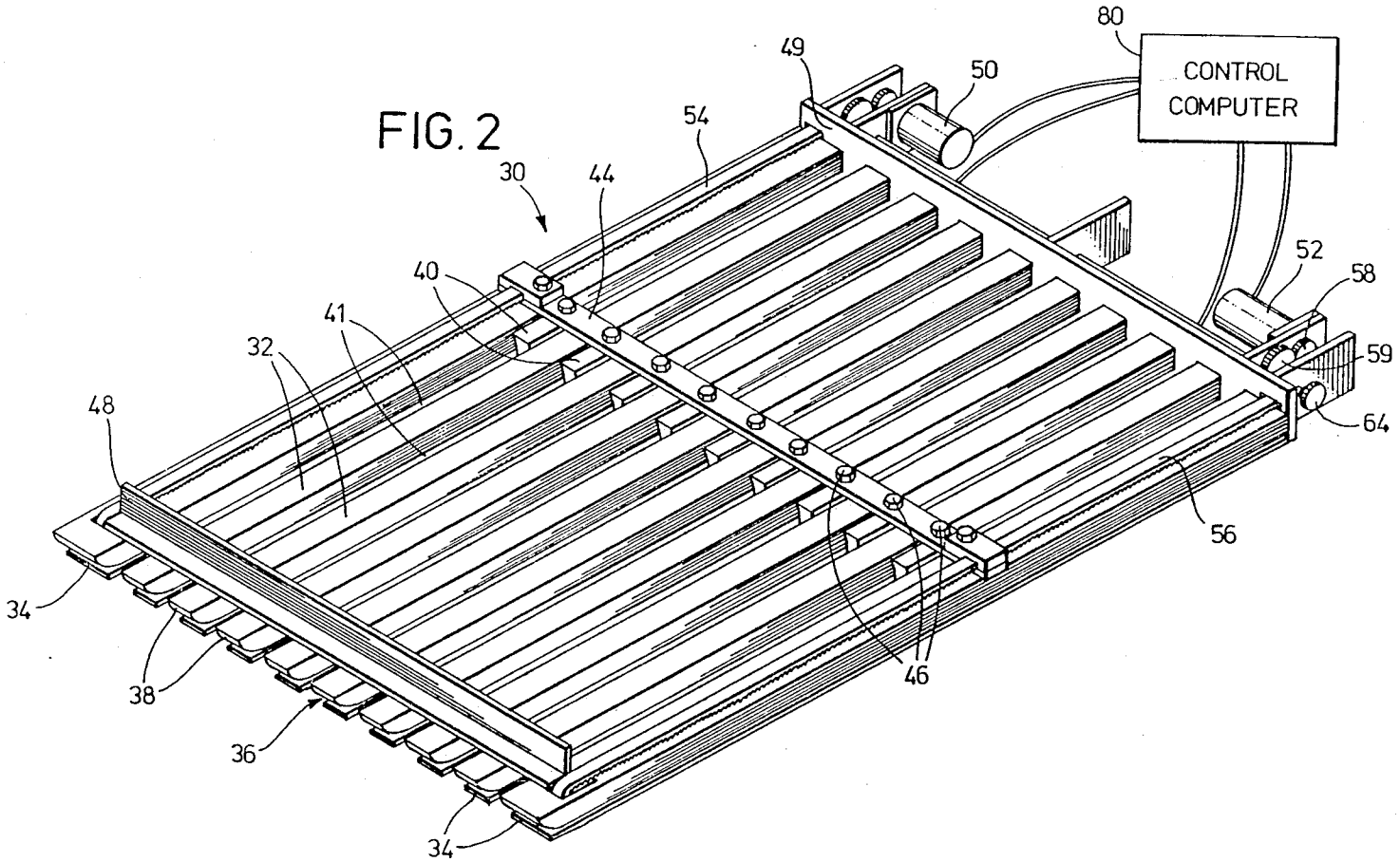
FIG. 2 is a perspective view of the fold-pan assembly of the present invention.

FIG. 2 illustrates in greater detail fold-pan assembly 30. It should be understood that several such fold-pan assemblies 30 are utilized in sheet folding machine 10, and their structures are all essentially the same. Fold-pan assembly 30 comprises a plurality of spaced apart upper plates 32 and lower plates 34 which define a space 36 between them for receiving sheets to be folded. The sheets are received at sheet-entrance mouth 38, which is defined by the open space between the upper and lower plates at the end of fold-pan assembly 30.

Figure 4:
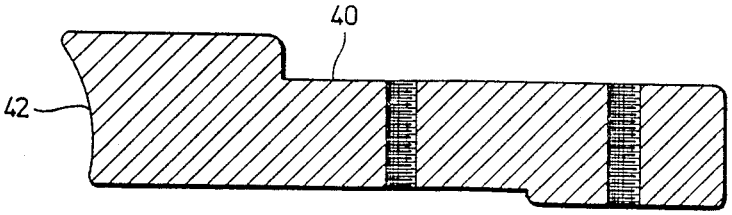
FIG. 4 is a sectional side view of a paper stop used in the practice of the present invention.

A plurality of paper stops 40 are movable in gaps 41 between the plurality of spaced upper plates 32. Paper stops 40, best shown in FIG. 4, are positioned such that their respective front facing surfaces 42 extend into open space 36 betwen the upper and lower plates. Surfaces 42 stop the sheets from traveling any further into the fold-pan assembly 30, and are set, as described in further detail below, so that the inserted sheets are folded at the desired location.

A bar assembly 44 extends transversely across upper plates 32 so that the paper stops 40 may move in unison toward and away from sheet-entrance mouth 38. Suitable fastening devices such as bolts 46 secure the paper stops 40 to bar assembly 44.

Abutment bar 48, located near sheet-entrance mouth 38 secures upper plates 32 together. Abutment bar 48 is located so that when bar assembly 44 is adjacent thereto, the front facing surfaces 42 of paper stops 40 will be substantially at the sheet-entrance mouth 38 of the fold-pan assembly. In this position, the paper stops 40, with curved front facing surfaces 42, act as sheet deflectors.

This positioning of the papers stops 40 is desirable when only some of the many fold-pan assemblies in folding machine 10 need to be utilized for a particular job. The curved front facing surfaces 42 on the paper stops 40 act to cause the sheets being fed to follow the track of the rollers in the folding machine and to deflect the sheets away from sheet-entrance mouth 38.

At the opposite end of fold-pan assembly 30 is a rear support bar 49. Rear support bar 49 is attached to plates 32 and 34 and supports a number of machine elements including limit switches 66 and 68, as explained in further detail below.

Figure 3:
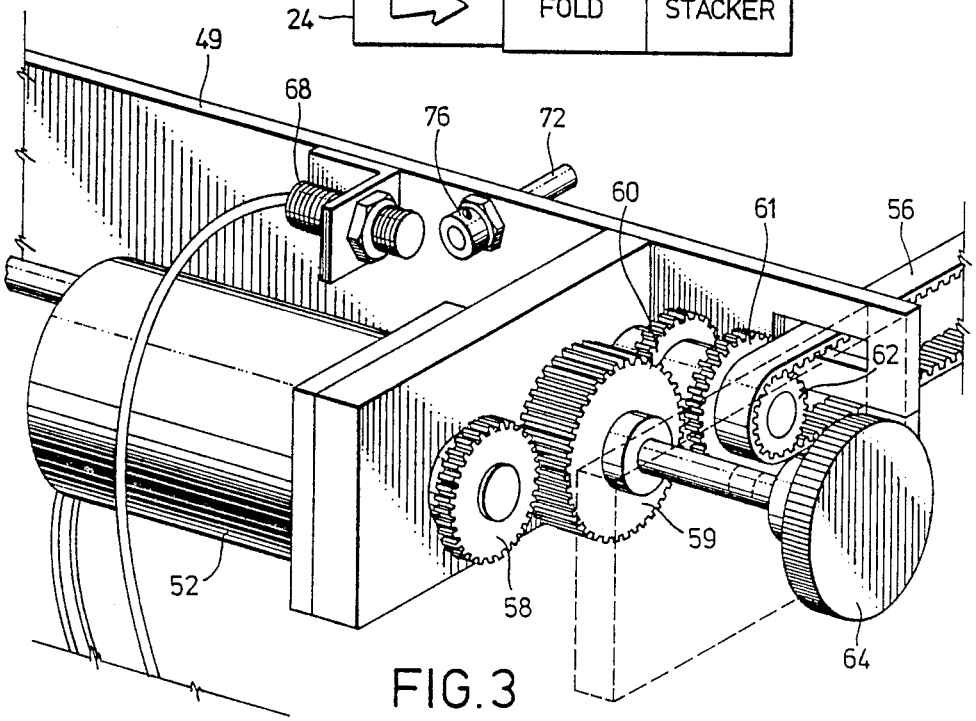
FIG. 3 is a somewhat enlarged rear perspective view of the stepper motor and gear arrangement on the fold-pan assembly.

Referring now to FIGS. 3 and 4, bar assembly 44, having paper stops 40 secured thereto, is driven toward and away from sheet-mouth entrance 38 by stepper motors 50 and 52 which operate timing belts 54 and 56, respectively. As shown in FIG. 2, bar assembly 44 is secured to timing belts 54 and 56 so that paper stops 40 are driven in unison.

As best shown in FIG. 3, stepping motor 52 drives gear 58 which in turn drives gears 59 and 60. Gear 60 is on the same spindle as gear 62 around which timing belt 56 extends. Thus, operation of stepper motor 52 causes movement of timing belt 56 through intervening gears 58, 59, 60 and 62.

Provision is also made for manual operation and positioning of bar assembly 44. Adjustment knob 64, best shown in FIG. 3, may be pulled outwardly moving gear 59 out of engagement with gear 60 and into engagement with gear 61. Manual adjustment of knob 64 then causes timing belt 56 to move in response. Similarly, a manual adjustment knob (not shown) associated with the opposite end of pan-fold assembly 30 can provide manual adjustment of timing belt 54.

A pair of limit switches 66 and 68, respectively, are mounted on rear stop bar 49 to detect the rearward movement of paper stops 40 against rear stop bar 49. FIG. 3 illustrates the construction of limit switch 68 and its positioning. Corresponding limit switch 66 operates in substantially the same manner. As paper stops 40 move rearwardly toward rear support bar 49, metal plunger 72 is contacted. Plunger 72 is supported in plunger support member 76 and is normally biased by a spring (not shown) outwardly from rear stop bar 49. As plunger 72 moves rearwardly through plunger support member 76, its presence is detected by limit switch 68 which is preferably a proximity switch. This information is relayed to computer control means 80 which, in turn, deactivates stepper motor 52. Limit switches 66 and 68 may be magnetic proximity switches, such as Model No. E2F-X2E2 proximity switches manufactured by Omron Corporation.

The computer control means 80 includes a video monitor 82 and a keyboard 84 from which information may be inputted into the computer. In a preferred embodiment of the invention, the computer is a System 3000 manufactured by Tandy Corporation. Software is provided to operate the computer control system to enable automatic operation of the multiple pan-fold assemblies in sheet folding machine 10. A computer listing of the preferred software for computer 80 is appended to the end of this specification.

The software operates computer 80 as follows. Upon start up of the system, the program initializes all of the variables in the system and causes position controller 86 and motor drive 88 to move the paper stops to an initial position. The operator is then prompted to enter variables into computer 80 including the number of fold pans to be in operation and the length of paper to be folded. The software program automatically calculates the proper paper stop positions and then activates stepper motors 50 and 52 to position the bar assemblies 44 and 44' to their proper positions relative to the sheet entrance mouth 38.

Computer 80, in conjunction with position controller 86 and motor drive 88, operates the stepper motor pairs on individual pan assemblies. In a preferred embodiment of the invention, the motor drive may be a model DPF72 manufactured by Anaheim Automation, the position controller may be model DPF37, also manufactured by Anaheim Automation, and the stepper motors may be model numbers 23PMC401 also manufactured by Anaheim Automation.

Figure 5:
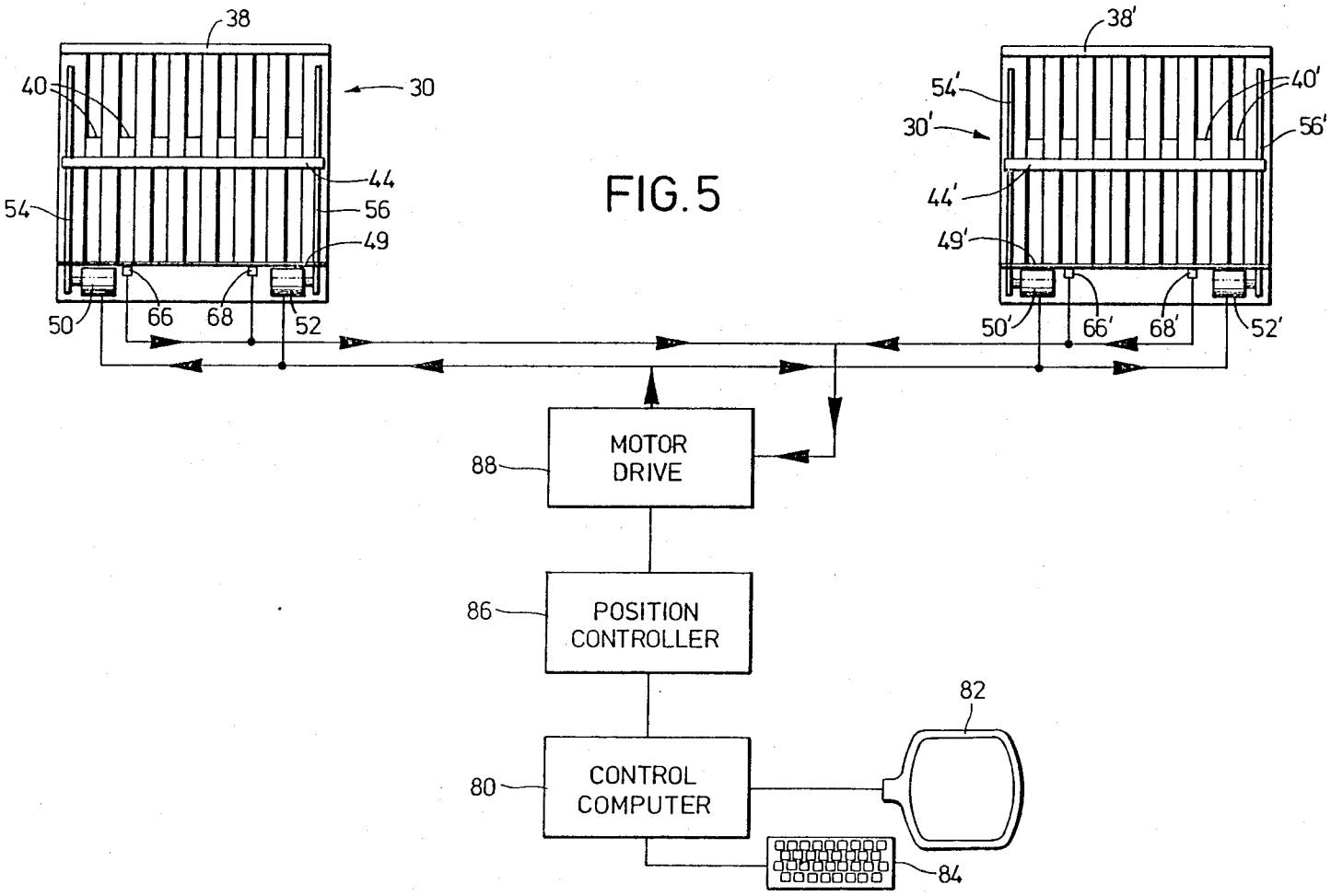
FIG. 5 is a schematic view of the automatic fold-pan assembly of the present invention with computer control means.

FIG. 5 illustrates schematically how computer 80 controls the operation of two fold-pan assemblies 30 and 30'. The operator of the sheet folding machine inputs information into computer 80 through keyboard 84. This information relates to the length of the sheets to be fed and the positioning of bar assemblies 44 and 44' in their respective pan-fold assemblies. This, in turn, results in the sheets which travel into the pan-fold assemblies being folded at the desired location. The software also permits the operator to input information which will cause biasing of the bar assembly.

Upon start-up of sheet folding machine 10, stepper motors 50, 52, 50' and 52' initialize the location of paper stops 40 adjacent rear support bar 49. The information inputted into computer 80 is then utilized by position controller 86 in conjunction with motor drive 88 to drive the stepper motors and cause the paper stops to be advanced to the desired locations.

Stepper motors 50 and 52 and 50' and 52' may be operated independently. This independent operation of the stepper motors permits biasing of the respective bar assemblies to compensate for printed sheets having printing thereon which is skewed somewhat from either a normal or parallel relationship to the edge of the printed sheets. That is, for example, stepper motor 50 may cause the left end of bar assembly 44 to move slightly farther forward than the right end. This compensates for a printed sheet having skewed printing thereon. Such biasing of the bar assembly may be accomplished either automatically by the operator inputting information into computer 80, or may be adjusted manually through the use of manual adjustment knob 64 as explained above. Where a particular pan assembly is not to be utilized for a particular job, computer 80 directs the stepper motors to drive the bar assembly and associated paper stops all the way forward to sheet-entrance mouth 38. There, the curved foward facing surfaces 42 of paper stops 40 act as sheet deflectors causing the sheets to be passed along to the next pan assembly in the system.

To accommodate sheets having one or more tabs extending therefrom, one or more of the paper stops 40 can be removed from the bar assembly 44. This permits the tabs on the sheets to be inserted further into the assembly and yet not interfere with the proper positioning of the sheet against the remaining paper stops.

```
REM TITLE INITIALIZATION OF SYSTEM/VARIABLES
SCREEN 0 : CLS : SCREEN 9 : CLS
  PAPER.BAS - PROGRAM NAME

  PAPER.BAS IS THE COMPOSITE OF PAPER04.BAS (MENU SECTIONS) AND
  MOTCON6B.BAS (MOTOR CONTROL ROUTINES)

  PAPER04.BAS A COLLECTION OF ROUTINES THAT INTERFACES A PERSONAL
  COMPUTER CONTROL PROGRAM FOR A PAPER FOLDING MACHINE

GOSUB INIT.VAR                                  'GO INIT VARIABLES

ON ERROR GOTO ERROR.ROUT                        'SET UP ERROR ROUTINE

COLOR FOR.GND,BACK.GND   ' MODIFY TO DAVES SETTINGS
GOSUB INIT.MOT

GOTO PAPER01                 'GO TO START OF THE MASTER MAIN MENU ROUTINE
INIT.VAR:                         'INITIALIZE SYSTEM VARIABLES

    FOLD.ACTIVE = 4                             'SET TO HIGHEST ACTIVE FOLDPAN
    AXIS.ACTIVE$ = "12345678"                   'TEST AXIS 1 AND 2 ONLY
    SCREEN 9        'MOVE TO INIT.VAR

    WAIT.DELAY = 30   ' MOVE TO INIT.VAR
    CR$ = CHR$(13)                              'SET THE (CR)
    ESC$ = CHR$(27)                             'SET THE (ESC) VALUE
    CONT.P$ = CHR$(16)                          'SET CONT-P KEY
    FOR.GND = 15                                'FOREFROUND COLOR
    BACK.GND = 1                                'BACK GROUND COLOR
    BORDER = 1                                  'BORDER COLOR

    RUN.BASE.SPEED$ = "20"                      'NORMAL RUN SPEED
    HOME.BASE.SPEED$ = "60"                     'GO TO HOME BASE SPEED
```

```
    BASE.SPEED$ = RUN.BASE.SPEED$

    STEP.SIZE = .005                                    '0.005 INCHES PER STEP

    FOLDPAN1 = 24.605 : FOLDPAN2 = 24.49 : FOLDPAN3 = 15.665
    FOLDPAN4 = 15.8
    FOLD.MAX(1) = 24.605 : FOLD.MAX(2) = 24.49
    FOLD.MAX(3) = 15.665 : FOLD.MAX(4) = 15.8
    DEFLECT(1) = .350 : DEFLECT(2) = .350 : DEFLECT(3) = .350 : DEFLECT(4) = .35
0

    'INITIALIZE COMMUNICATIONS PORT
    OPEN "COM1:4800,N,8,2,CS1000" AS 2
    COM.STAT = 1
    RETURN


REM TITLE MENU ROUTINES
REM PAGE

START:                                          'START POINT OF PROGRAM
    GOSUB HOME                                  'SEND FOLDPANS TO HOME
START.1:                                        'START AFTER HOME
'GOTO MAIN.BODY                                  'BYPASS GRAPHIC MENUS

PAPER01:
      WHILE 1=1
        CLS
        CALL BOX (X+2,X+2,X+22,X+78,X+6,X+15)
        LOCATE   4,17 : PRINT "          I M P O S I T I O N S "
        LOCATE   8,7 : PRINT" 1. 4-PAGE"
        LOCATE   8,43 : PRINT" 5. 8-PAGE"
        LOCATE   9,43 : PRINT"    PARALLEL"
        LOCATE  11,7 : PRINT" 2. 4-PAGE"
        LOCATE  11,43 : PRINT" 6. 8-PAGE"
        LOCATE  12,7 : PRINT"    DOUBLE IMPOSITION"
        LOCATE  12,43 : PRINT"    PARALLEL"
        LOCATE  13,43 : PRINT"    OVER & OVER FOLD"
        LOCATE  15,7 : PRINT" 3. 6-PAGE"
        LOCATE  15,43 : PRINT" 7. CREATE YOUR"
        LOCATE  16,7 : PRINT"    STANDARD"
        LOCATE  16,43 : PRINT"    OWN FOLD"
        LOCATE  18,7 : PRINT" 4. 6-PAGE"
        LOCATE  18,43 : PRINT" 8. INITIALIZE"
        LOCATE  19,7 : PRINT"    ACCORDIAN"
        LOCATE  19,43 : PRINT"    FOLD STOPS"
        GOSUB GRAPH.SMALL
        LOCATE  22,30 : PRINT"  WHICH ONE? "
        START = TIMER

        WHILE IN02$ <> CR$ AND START + WAIT.DELAY > TIMER
          IN$ = INKEY$
          FLAG = 0
          IF IN$ = ESC$ THEN GOSUB CONT.PRG : SYSTEM
          IF IN$ = CONT.P$ THEN GOSUB MAIN.MENU : IN02$ = CR$  ' CNTRL-P
          IF IN$ >= "1" AND IN$ <= "6" THEN GOSUB LENGTH : GOSUB PAPER02 : IN02$
 = CR$
          IF IN$ = "7" THEN GOSUB PAPER04: GOSUB PAPER02 : IN02$ = CR$
          IF IN$ = "8" THEN GOSUB HOME : IN02$ = CR$
        WEND

        IF IN02$ <> CR$ THEN SYSTEM
        IN02$ = " "
      WEND
   END

REM PAGE


REM SUBROUTINE FOR ENTERING LENGTH OF PAPER AND CALCULATING FOLDPAN POSITIONS

LENGTH:
```

```
LNTH = -1                                          'SET INITIAL VALUE OF LNTH

     ON VAL(IN$) GOSUB GRAPH1,GRAPH2,GRAPH3,GRAPH4,GRAPH5,GRAPH6
     LOCATE 20,30 : PRINT "ENTER PAPER LENGTH ";
             SCREEN 0
     WHILE LNTH <= 0
       LINE INPUT; LNTH$ : LNTH = VAL(LNTH$)
       WIDTH 80
       COLOR FOR.GND,BACK.GND
       IF LNTH$ = "" THEN FLAG = 1 : COLOR FOR.GND,BACK.GND : CLS : RETURN
       IF LNTH <= 0 THEN LOCATE 24,20 : BEEP : PRINT "INVALID ENTRY ... PLEASE E
NTER ANOTHER VALUE";
       COLOR FOR.GND,BACK.GND : LOCATE 23,49
     WEND

     IF (IN$ = "1") THEN
        FOLDPAN1=LNTH/2 : FOLDPAN2=DEFLECT(2) : FOLDPAN3=DEFLECT(3) : FOLDPAN4=D
EFLECT(4)
     ELSEIF (IN$ = "2") THEN
        FOLDPAN1=LNTH/4 : FOLDPAN2=LNTH/4 : FOLDPAN3=LNTH/4 : FOLDPAN4=DEFLECT(4
)
     ELSEIF (IN$ = "3") THEN
        FOLDPAN1=LNTH/3 : FOLDPAN2=0.35 : FOLDPAN3=LNTH/3 : FOLDPAN4=DEFLECT(4)
     ELSEIF (IN$ = "4") THEN
        FOLDPAN1=LNTH/3 : FOLDPAN2=LNTH/3 : FOLDPAN3=DEFLECT(3) : FOLDPAN4=DEFLE
CT(4)
     ELSEIF (IN$ = "5") THEN
        FOLDPAN1=LNTH/2 : FOLDPAN2=LNTH/4 : FOLDPAN3=DEFLECT(3) : FOLDPAN4=DEFLE
CT(4)
     ELSEIF (IN$ = "6") THEN
        FOLDPAN1=(LNTH/4)*3 : FOLDPAN2=LNTH/4 : FOLDPAN3=DEFLECT(3) : FOLDPAN4=
LNTH/4
     END IF

     FLAG1 = 0
     IF FOLDPAN1 > FOLD.MAX(1) THEN
       LOCATE 24,26 : BEEP : PRINT "SHEET LENGTH TOO LONG FOR FOLD"; : FLAG1 = 1
     ELSEIF FOLDPAN2 > FOLD.MAX(2) THEN
       LOCATE 24,26 : BEEP : PRINT "SHEET LENGTH TOO LONG FOR FOLD"; : FLAG1 = 1
     ELSEIF FOLDPAN3 > FOLD.MAX(3) THEN
       LOCATE 24,26 : BEEP : PRINT "SHEET LENGTH TOO LONG FOR FOLD"; : FLAG1 = 1
     ELSEIF FOLDPAN4 > FOLD.MAX(4) THEN
       LOCATE 24,26 : BEEP : PRINT "SHEET LENGTH TOO LONG FOR FOLD"; : FLAG1 = 1
     END IF
     IF FLAG1 = 1 THEN FOR I2 = 1 TO 6000 : NEXT I2 : GOTO LENGTH:


     GOSUB FOLD.POS
     COLOR FOR.GND,BACK.GND
     CLS
     RETURN

REM PAGE

REM    PAPER02 SUBROUTINE FOR SELECTING FOLDPAN FOR JOG PROCEDURES

PAPER02:
       FLAG9 = 0
          CLS
       WHILE IN02$ <> CR$ AND FLAG <> 1
            CLS
          CALL BOX (X+1,X+2,X+21,X+77,X+8,X+15)
          LOCATE 3,5 : PRINT "FOLD PAN # 1  -          inches"
          IF FOLDPAN1 <= DEFLECT(1) THEN LOCATE 3,22 : PRINT " DEFL "
          IF FOLDPAN1 > DEFLECT(1) THEN  LOCATE 3,22 : PRINT USING "##.###" ; FO
LDPAN1
          LOCATE 3,45 : PRINT "FOLD PAN # 3  -          inches"
          IF FOLDPAN3 <= DEFLECT(3) THEN LOCATE 3,62 : PRINT " DEFL "
          IF FOLDPAN3 > DEFLECT(3) THEN LOCATE 3,62 : PRINT USING "##.###" ; FOL
DPAN3
          LOCATE 5,5 : PRINT "FOLD PAN # 2  -          inches"
          IF FOLDPAN2 <= DEFLECT(2) THEN LOCATE 5,22 : PRINT " DEFL "
          IF FOLDPAN2 > DEFLECT(2) THEN LOCATE 5,22 : PRINT USING "##.###" ; FOL
```

```
DPAN2
          LOCATE 5,45 : PRINT "FOLD PAN # 4  -          inches"
          IF FOLDPAN4 <= DEFLECT(4) THEN LOCATE 5,62 : PRINT " DEFL "
          IF FOLDPAN4 > DEFLECT(4) THEN LOCATE 5,62 : PRINT USING "##.###" ; FOL
DPAN4
          LOCATE  11,26 : PRINT " 1. MOVE FOLD PAN # 1"
          LOCATE  13,26 : PRINT " 2. MOVE FOLD PAN # 2"
          LOCATE  15,26 : PRINT " 3. MOVE FOLD PAN # 3"
          LOCATE  17,26 : PRINT " 4. MOVE FOLD PAN # 4"
          LOCATE 21,32 : PRINT " Which One? "
          LOCATE 25,23 : PRINT " ENTER - RETURN TO MAIN MENU";
          IF FLAG9 = 1 THEN GOSUB POS.UPDATE
            WHILE (IN02$ <> CR$ AND (IN02$ < "1" OR IN02$ > "4"))
              IN02$ = INKEY$
              FOLD = VAL(IN02$)
              WEND

          IF (IN02$ <> CR$) THEN
             FOLDPAN = VAL(IN02$) : FLAG9 = 1 : GOSUB JOG.MENU : IN02$ = ""
          END IF

'LINE INPUT A$
        WEND
        RETURN

POS.UPDATE:
             GOSUB READ.AXIS
             FOR TRUNC = 1 TO 8 : DIST(TRUNC) = INT((DIST(TRUNC)+.0005)*1000)/10
00 : NEXT TRUNC
             IF FOLDPAN1 <> (DIST(1)+DIST(2))/2 THEN LOCATE 3,22 : PRINT USING "
##.###" ; DIST(1)
             IF DIST(1) <> DIST(2) THEN COLOR 14,BACK.GND : LOCATE 4,22 : PRINT
"BIASED"; : COLOR FOR.GND,BACK.GND

             IF FOLDPAN2 <> (DIST(3)+DIST(4))/2 THEN LOCATE 5,22 : PRINT USING "
##.###" ; DIST(3)
             IF DIST(3) <> DIST(4) THEN COLOR 14,BACK.GND : LOCATE 6,22 : PRINT
"BIASED"; : COLOR FOR.GND,BACK.GND

             IF FOLDPAN3 <> (DIST(5)+DIST(6))/2 THEN LOCATE 3,62 : PRINT USING "
##.###" ; DIST(5)
             IF DIST(5) <> DIST(6) THEN COLOR 14,BACK.GND : LOCATE 4,62 : PRINT
"BIASED"; : COLOR FOR.GND,BACK.GND

             IF FOLDPAN4 <> (DIST(7)+DIST(8))/2 THEN LOCATE 5,62 : PRINT USING "
##.###" ; DIST(7)
             IF DIST(7) <> DIST(8) THEN COLOR 14,BACK.GND : LOCATE 6,62 : PRINT
"BIASED"; : COLOR FOR.GND,BACK.GND

        RETURN

REM PAGE

REM          PAPER04 SUBROUTINE FOR CREATING YOUR OWN FOLD

PAPER04:

        CLS
        FOLDPAN1$ = " "
        FOLDPAN2$ = " "
        FOLDPAN3$ = " "
        FOLDPAN4$ = " "
        CALL BOX (X+1,X+2,X+17,X+77,X+5,X+15)
        '
        '  ENTER DESIRED VALUES OF FOLDPAN POSITIONS
        '
        LOCATE   3,30 : PRINT "CREATE YOUR OWN FOLD"
        LOCATE   7,8 : PRINT "ENTER REQUIRED LOCATION OF FOLD PAN #1          (D
FOR DEFLECT)"
        LOCATE   9,8 : PRINT "ENTER REQUIRED LOCATION OF FOLD PAN #2          (D
FOR DEFLECT)"
        LOCATE   11,8 : PRINT "ENTER REQUIRED LOCATION OF FOLD PAN #3          (
D FOR DEFLECT)"
        LOCATE   13,8 : PRINT "ENTER REQUIRED LOCATION OF FOLD PAN #4          (
```

```
D FOR DEFLECT)"
        LOCATE   17,24 : PRINT " ENTER - RETURN TO MAIN MENU "
        LOCATE   7,49 : LINE INPUT FOLDPAN1$ : IF FOLDPAN1$ = "" THEN FLAG = 1 :
GOTO881

        LOCATE   9,49 : LINE INPUT FOLDPAN2$
        LOCATE   11,49 : LINE INPUT FOLDPAN3$
        LOCATE   13,49 : LINE INPUT FOLDPAN4$
        FOLDPAN1 = VAL(FOLDPAN1$)              ' CONVERT CHAR TO NUMERIC
        FOLDPAN2 = VAL(FOLDPAN2$)              ' CONVERT CHAR TO NUMERIC
        FOLDPAN3 = VAL(FOLDPAN3$)              ' CONVERT CHAR TO NUMERIC
        FOLDPAN4 = VAL(FOLDPAN4$)              ' CONVERT CHAR TO NUMERIC
        IF FOLDPAN1 < DEFLECT(1) THEN FOLDPAN1 = DEFLECT(1)
        IF FOLDPAN2 < DEFLECT(2) THEN FOLDPAN2 = DEFLECT(2)
        IF FOLDPAN3 < DEFLECT(3) THEN FOLDPAN3 = DEFLECT(3)
        IF FOLDPAN4 < DEFLECT(4) THEN FOLDPAN4 = DEFLECT(4)

        GOSUB FOLD.POS        ' GOSUB TO MOTOR ROUTINES

        RETURN

REM PAGE

REM  SUBROUTINES FOR DRAWING GRAPHS

GRAPH1:

        CLS
        VIEW (120,28) - (600,250)
        WINDOW (0,0) - (35,25)
        LINE (8,3) - (8,22) : LINE - (20,25) : LINE - (20,7) : LINE - (19,6.5)
        LINE (8,3) - (19,1) : LINE - (19,20) : LINE - (8,22)
        PAINT (15,15),15,15 : PAINT (18,23),7,15
        LINE (8,3) - (8,22) : LINE - (20,25) : LINE - (20,7) : LINE - (19,6.5)
        LINE (8,3) - (19,1) : LINE - (19,20),0 : LINE - (8,22),0
        VIEW
        RETURN


GRAPH2:

        CLS
        VIEW (80,28) - (570,250)
        WINDOW (0,0) - (30,25)
        LINE (13,20) - (13,2) : LINE - (22,4) : LINE - (22,22) : LINE - (13,20)
        LINE (13,5) - (9,4) : LINE - (9,22) : LINE - (18,23) : LINE - (18,21)
        LINE (9,22) - (15,24.5) : LINE - (15,22.5) : LINE (13,20) - (18,23)
        PAINT (15,15),15,15 : PAINT (11,15),9,15 : PAINT (17,22),7,15 : PAINT (1
4,23),15,15
        LINE (13,20) - (13,2),0 : LINE - (22,4) : LINE - (22,22) : LINE - (13,20
),0
        LINE (13,5) - (9,4) : LINE - (9,22) : LINE - (18,23),0 : LINE - (18,21)
        LINE (9,22) - (15,24.5) : LINE - (15,22.5) : LINE (13,20) - (18,23),0
        VIEW
        RETURN


GRAPH3:

        CLS
        VIEW (60,28) - (550,250)
        WINDOW (0,0) - (30,25)
        LINE (10,6.5) - (16.5,2.5) : LINE - (16.5,20.25) : LINE - (10,24) : LINE
 - (10,6.5)
        LINE (10,24) - (22,25) : LINE - (22,7.5) : LINE - (16.5,5.5)
        LINE (22,25) - (15,23) : LINE - (15,21)
        PAINT (15,15),15,15 : PAINT (20,15),9,15 : PAINT (14,23),7,15
'        LINE (11,6) - (17,2) : LINE - (16.5,19),0 : LINE - (10,24),0 : LINE - (
11,6)
'        LINE (10,24) - (22,25) : LINE - (23,8) : LINE - (17,5.5)
'        LINE (22,25) - (13.5,22),0 : LINE - (13.75,21),0
        VIEW
        RETURN
```

```
REM PAGE

GRAPH4:

        CLS
        VIEW (80,28) - (570,250)
        WINDOW (0,0) - (30,25)
        LINE (9,0) - (22,2) : LINE - (22,20) : LINE - (9,18) : LINE - (9,0)
        LINE (9,4.5) - (8,5) : LINE - (8,23) : LINE - (21,25) : LINE - (21,20.25
)
        LINE (8,23) - (22,20)
        PAINT (15,15),15,15 : PAINT (15,20),9,15 : PAINT (15,23),7,15
        LINE (9,0) - (22,2) : LINE - (22,20) : LINE - (9,18),0 : LINE - (9,0),0
        LINE (9,4.5) - (8,5) : LINE - (8,23) : LINE - (21,25) : LINE - (21,20.25
)
        LINE (8,23) - (22,20),0
        VIEW
        RETURN

GRAPH5:

        CLS
        VIEW (60,28) - (550,250)
        WINDOW (0,0) - (30,25)
        LINE (9,4) - (22,2) : LINE - (22,20) : LINE - (9,22) : LINE - (9,4)
        LINE (9,22) - (22,24) : LINE - (15,22) : LINE - (24,21) : LINE - (24,4)
        LINE - (22,4.5) : LINE (22,24) - (22,21) : LINE (15,22) - (15,21)
        PAINT (15,15),15,15 : PAINT (23,15),9,15 : PAINT (12,22),7,15 : PAINT (2
1,22),15,15
'        LINE (9,4) - (22,2) : LINE - (22,20),0 : LINE - (9,22),0 : LINE - (9,4)
'        LINE (9,22) - (22,24) : LINE - (15,22),0 : LINE - (24,21),0 : LINE - (2
4,4)
'        LINE - (22,4.5) : LINE (22,24) - (22,21)
        VIEW
        RETURN

GRAPH6:

        CLS
        VIEW (100,28) - (590,250)
        WINDOW (0,0) - (35,25)
        LINE (8,4.5) - (18,2) : LINE - (18,20) : LINE - (8,22.5) : LINE - (8,4.5
)
        LINE (8,22.5) - (21,25) : LINE - (21,7) : LINE - (18,4.5)
        LINE (21,25) - (16,20.6) : LINE - (18.5,24) : LINE - (18.5,22.5)
        PAINT (15,15),15,15 : PAINT (20,15),9,15 : PAINT (15,22),7,15 : PAINT (1
8,23),15,15
'        LINE (4,5) - (15,2) : LINE - (15,20),0 : LINE - (4,23),0 : LINE - (4,5)
'        LINE (4,23) - (24,24) : LINE - (24,7) : LINE - (15,3.5)
'        LINE (24,24) - (13,20.5),0 : LINE - (21,23.5),0 : LINE - (21,23),0
        VIEW
        RETURN

REM PAGE

GRAPH.SMALL:

        VIEW (152,88) - (202,128)
        WINDOW (0,0) - (35,25)
        LINE (8,3) - (8,22) : LINE - (20,25) : LINE - (20,7) : LINE - (19,6.5)
        LINE (8,3) - (19,1) : LINE - (19,20) : LINE - (8,22)
        PAINT (15,15) : PAINT (18,23)
        LINE (8,3) - (8,22) : LINE - (20,25) : LINE - (20,7) : LINE - (19,6.5)
        LINE (8,3) - (19,1) : LINE - (19,20),0 : LINE - (8,22),0
REM  GRAPH2.SMALL

        VIEW (240,140) - (290,180)
        WINDOW (0,0) - (30,25)
        LINE (13,20) - (13,2) : LINE - (22,4) : LINE - (22,22) : LINE - (13,20)
        LINE (13,5) - (9.4) : LINE - (9,22) : LINE - (18,23) : LINE - (18,21)
```

```
        LINE (9,22) - (15,24.5) : LINE - (15,22.5) : LINE (13,20) - (18,23)
        PAINT (15,15) : PAINT (11,15) : PAINT (17,22) : PAINT (14,23)
        LINE (13,20) - (13,2),0 : LINE - (22,4) : LINE - (22,22) : LINE - (13,20
),0

        LINE (13,5) - (9,4) : LINE - (9,22) : LINE - (18,23),0 : LINE - (18,21)
        LINE (9,22) - (15,24.5) : LINE - (15,22.5) : LINE (13,20) - (18,23),0

REM  GRAPH3.SMALL

        VIEW (168,189) - (218,229)
        WINDOW (0,0) - (30,25)
        LINE (10,6.5) - (16.5,2.5) : LINE - (16.5,20.25) : LINE - (10,24) : LINE
 - (10,6.5)
        LINE (10,24) - (22,25) : LINE - (22,7.5) : LINE - (16.5,5.5)
        LINE (22,25) - (15,23) : LINE - (15,21)
        PAINT (15,15) : PAINT (20,15) : PAINT (14,23)
        LINE (10,6.5) - (16.5,2.5) : LINE - (16.5,20.25),0 : LINE - (10,24),0 :
LINE - (10,6.5)
        LINE (10,24) - (22,25) : LINE - (22,7.5) : LINE - (16.5,5.5)
        LINE (22,25) - (15,23),0 : LINE - (15,21),0

REM PAGE

REM  GRAPH4.SMALL

        VIEW (176,238) - (226,278)
        WINDOW (0,0) - (30,25)
        LINE (9,0) - (22,2) : LINE - (22,20) : LINE - (9,18) : LINE - (9,0)
        LINE (9,4.5) - (8,5) : LINE - (8,23) : LINE - (21,25) : LINE - (21,20.25
)
        LINE (8,23) - (22,20)
        PAINT (15,15) : PAINT (15,20) : PAINT (15,23)
        LINE (9,0) - (22,2) : LINE - (22,20) : LINE - (9,18),0 : LINE - (9,0),0
        LINE (9,4.5) - (8,5) : LINE - (8,23) : LINE - (21,25) : LINE - (21,20.25
)
        LINE (8,23) - (22,20),0

REM  GRAPH5.SMALL

        VIEW (456,88) - (522,128)
        WINDOW (0,0) - (30,26)
        LINE (9,4) - (22,2) : LINE - (22,19.5) : LINE - (9,22) : LINE - (9,4)
        LINE (9,22) - (22,26) : LINE - (15,22) : LINE - (24,21.5) : LINE - (24,4
)
        LINE - (22,4.5) : LINE (22,26) - (22,21) : LINE (15,22) - (15,21)
        PAINT (15,15) : PAINT (23,15) : PAINT (12,22) : PAINT (21,22)
        LINE (9,4) - (22,2) : LINE - (22,19.5),0 : LINE - (9,22),0 : LINE - (9,4
)
        LINE (9,22) - (22,26) : LINE - (15,22),0 : LINE - (24,21.5),0 : LINE - (
24,4)
        LINE - (22,4.5) : LINE (22,26) - (22,21)

REM  GRAPH6.SMALL

        VIEW (520,140) - (570,180)
        WINDOW (0,0) - (35,25)
        LINE (8,4.5) - (18,2) : LINE - (18,20) : LINE - (8,22.5) : LINE - (8,4.5
        LINE (8,22.5) - (21,25) : LINE - (21,7) : LINE - (18,4.5)
        LINE (21,25) - (16,20.6) : LINE - (17.5,24) : LINE - (17.5,22.5)
        PAINT (14,15) : PAINT (16,15) : PAINT (15,22) : PAINT (20,23)
        LINE (8,4.5) - (18,2) : LINE - (18,20),0 : LINE - (8,22.5),0 : LINE - (8
,4.5)
        LINE (8,22.5) - (21,25) : LINE - (21,7) : LINE - (18,4.5)
        LINE (21,25) - (16,20.6),0 : LINE - (17.5,24),0 : LINE - (17.5,22.5),0
        VIEW
        RETURN


REM TITLE MOTOR CONTROL ROUTINES
REM PAGE

' MOTCON6B.BAS                          'LAST MODIFIED 9/19/86

' PROGRAMMED BY DAVID L. BADGLEY
```

```
CLS
GOTO MAIN.BODY                                          'GO TO MAIN BODY

SUB OUT.CMD (OUT$,ERR.CODE) STATIC                      'REM OUTPUT DATA ROUTINE
100 'REFERENCE FOR COMMUNICATION ERROR
 SHARED PAUSE$
 LOOP = 1000 : ERR.CODE = 1
 WHILE ERR.CODE = 1
   IF  1=0  THEN            'ADD TEST FOR RS-232 (CTS) LINE
     LOOP = LOOP - 1                                     'DECREMENT COUNTER
   ELSE
   PRINT #2, OUT$;"  "                                   'OUTPUT DATA TO SERIAL PORT
     IF PAUSE$ = "Y" THEN                                 'CHECK FOR PAUSE
       LOCATE 22,1 : PRINT OUT$; : BEEP : PRINT "   PRESS (ENTER)";
       LINE INPUT A$
     END IF
   END IF

  'CONTROLLER TIME OUT
   IF LOOP = 0 THEN
     LOCATE 23,1 : PRINT "CONTROLLER TIME OUT - PRESS (R) TO REPEAT ";
     BEEP
     IN$ = INKEY$
     WHILE IN$ <> "R" OR IN$ <> ESC$
       IN$ = INKEY$
       IF IN$ = ESC$ THEN
         ERR.CODE = 0                                    'SET ERROR CODE
       ELSE
         ERR.CODE = 1                                    'LOOP AGAIN
         LOOP = 1000                                     'RESET COUNTER
       END IF
     WEND
   ELSE
     ERR.CODE = 2                                        'SET CODE TO GOOD
   END IF

 WEND
 END SUB
REM TITLE READ POSITION ROUTINES
REM PAGE
200  'REFERENCE FOR COMMUNICTION ERROR
     ' READ POSITION OF A SINGLE AXIS

  OUT$ = " Y" + AXIS.STAT$
  CALL OUT.CMD (OUT$,ERR.CODE)
  OUT$ = " VP "
  CALL OUT.CMD (OUT$,ERR.CODE)

  L.CNT = 100                                            'SET TIME OUT LOOP COUNT

'  WHILE L.CNT > 0
'      IF LOC(2) > 2 THEN
'        INPUT #2,DATA.READ$
'        L.CNT = -1                                      'SET STATUS TO OKAY
'      ELSE
'        L.CNT = L.CNT - 1
'      END IF
'  WEND

  IF L.CNT = 0 THEN
     BEEP : LOCATE 25,1
     PRINT "CONTROLER IS NOT SENDING  DATA - PRESS (R) TO RETRY OR (RETURN) ABOR
T";

     IN$ = ""
     WHILE IN$ <> CR$ AND IN$ <> "R"
       IN$ = INKEY$
     WEND

     IF IN$ = "R" THEN GOTO READ.POS                     'RETRY THE READ COMMAND
     IF IN$ = CR$ THEN GOTO START                        'GOTO START OF PROGRAM
```

```
  END IF
     POS.READ$ = MID$(DATA.READ$,2,5)
     STEP.READ = VAL(POS.READ$)
     DIST.READ = STEP.READ * STEP.SIZE          'CONVERT FROM STEPS TO INCHES
     RETURN


DISP.STATUS:

     REM DISPLAY STATUS
      COLOR 8,7
     LOCATE ROW.STAT,1
     FMT.STAT$ = "FOLD PAN: #  LEFT: ###.### IN.  RIGHT ###.### IN.
        "
     PRINT USING FMT.STAT$; FOLD,DIST.LEFT,DIST.RIGHT;
     COLOR FOR.GND,BACK.GND,BORDER
     RETURN

REM TITLE MAIN MENU ROUTINES
REM PAGE

MAIN.BODY:                          'MAIN BODY OF PROGRAM
      GOSUB MAIN.MENU
      SYSTEM


MAIN.MENU:
UPDATE = 0
IN$ = INKEY$
WHILE IN$ <> CR$                    'CHECK FOR RETURN KEY

  IF UPDATE = 0 THEN
    CLS
    X = 0
    CALL BOX(X+2,X+5,X+20,X+75,X+ 5,FOR.GND)
    LOCATE 4,30  : PRINT "MOTOR CONTROL MENU"
    LOCATE 7,7   : PRINT " 1 - INITIALIZE MOTOR CONTROLLER "
    LOCATE 9,7   : PRINT " 2 - CHANGE VARIABLES "
    LOCATE 11,7  : PRINT " 3 - LOAD PROGRAM TO CONTROLLER"
    LOCATE 13,7  : PRINT " 4 - SET PROGRAM DEFAULTS"
    LOCATE 15,7  : PRINT " 5 - JOG MENU"
    LOCATE 7,45  : PRINT " 6 - CONTROLLER COMMANDS"
    LOCATE 9,45  : PRINT " 7 - SEEK HOME"
    LOCATE 11,45 : PRINT " 8 - MOVE PAPER STOPS"
    LOCATE 13,45 : PRINT " 9 - READ ALL AXIS POSITIONS"


    LOCATE 23,30 : PRINT "PRESS (RETURN) TO EXIT"
    UPDATE = 1                          'SET SCREEN UPDATE STATUS
  END IF

  IN$ = INKEY$
  IN = VAL(IN$)
  IF IN$ >= "0" AND IN$ <= "9" THEN

    ON IN GOSUB INIT.MOT,CHG.MENU,CONT.PRG,SET.VAR,JOG.MENU.1,CONTR.CMD,HOME,MOV
E.PAN,READ.AXIS
    UPDATE = 0                      'CLEAR FLAG - CAUSE UPDATE OF MENU
    IN$ = INKEY$

  END IF

WEND
RETURN

CHG.MENU:                           'CHANGE VARIABLE MENU
 RETURN

REM TITLE JOG MENU
REM PAGE

JOG.MENU.1:
    INPUT "ENTER FOLDPAN NUMBER ";FOLD
```

```
JOG.MENU:                    'JOG MENU

    CLS

    IF FOLD = 1 THEN AXIS.TEMP$ = "12"
    IF FOLD = 2 THEN AXIS.TEMP$ = "34"
    IF FOLD = 3 THEN AXIS.TEMP$ = "56"
    IF FOLD = 4 THEN AXIS.TEMP$ = "78"
    FOLD.MAX = FOLD.MAX(FOLD)                'SET MAX FOLD POSITION
    FOLD.MIN = DEFLECT(FOLD)                 'SET MIN FOLD POSITION
    X = 0
    CALL BOX(X+2,X+5,X+20,X+75,X+ 5,FOR.GND)

    GOSUB READ.JOG.POS
    CALL OUT.CMD (" Y" + AXIS.TEMP$,ERR.CODE)          'SELECT AXIS
    AXIS.STEP$ = AXIS.TEMP$                            'SET ACTIVE AXIS
    LOCATE 4,28  : PRINT " JOG FOLD PAN #";FOLD;" "
    LOCATE 7,22 : PRINT " PRESS (+) KEY FOR POSITVE  MOVEMENT "
    LOCATE 9,22 : PRINT " PRESS (-) KEY FOR NEGATIVE MOVEMENT "
    LOCATE 15,22 : PRINT " PRESS (B) FOR BIAS MENU "
    LOCATE 23,20 : PRINT " PRESS (RETURN) TO RETURN TO MAIN MENU "

JOG.1:
  IN.TEMP$ = INKEY$
  CNT.TEMP = 0
  WHILE IN.TEMP$ = "" AND CNT.TEMP < 250
    CNT.TEMP = CNT.TEMP + 1
    IN.TEMP$ = INKEY$
  WEND
  IN.PREV$ = IN$
  IN$ = IN.TEMP$

  IF IN$ = CR$ THEN COLOR FOR.GND,BACK.GND,BORDER : CLS : RETURN
  IF IN$ = "B" THEN
    GOSUB BIAS.MENU
    RETURN                          'RETURN TO MAIN MENU
  END IF

  IF IN$ = "+" OR IN$ = "-" THEN
    GOSUB STEP.MOT                          'RUN STEPPER ROUTINE
    A$ = INKEY$ : A$ = INKEY$ : A$ = INKEY$ : A$ = INKEY$
  END IF

  GOTO JOG.1                                        'LOOP AGAIN FOR A KEY

REM TITLE BIAS AXIS MENU
REM PAGE

BIAS.MENU:
  CLS
  X = 0
  CALL BOX(X+2,X+5,X+20,X+75,X+ 5,FOR.GND)

  GOSUB READ.JOG.POS

  LOCATE 3,20  : PRINT " BIAS FOLD PAN #";FOLD;" "
  LOCATE 12,22 : PRINT " PRESS (+) KEY FOR POSITIVE MOVEMENT "
  LOCATE 14,22 : PRINT " PRESS (-) KEY FOR NEGATIVE MOVEMENT "
  LOCATE 7,22 : PRINT " PRESS (L) TO SELECT LEFT AXIS "
  LOCATE 9,22 : PRINT " PRESS (R) TO SELECT RIGHT AXIS "
  LOCATE 23,20 : PRINT " PRESS (RETURN) TO RETURN TO MAIN MENU "

IN$ = ""
WHILE IN$ <> CR$
  IN.TEMP$ = INKEY$
  CNT.TEMP = 0
  WHILE IN.TEMP$ = "" AND CNT.TEMP < 250
    CNT.TEMP = CNT.TEMP + 1
    IN.TEMP$ = INKEY$
  WEND

  IN.PREV$ = IN$
  IN$ = IN.TEMP$
```

```
  IF IN$ = "L" THEN
    AXIS.STEP$ = MID$(AXIS.TEMP$,1,1)
    AXIS.BIAS$ = "L"
    COLOR 14,BACK.GND
    LOCATE 7,22 : PRINT " PRESS (L) TO SELECT LEFT AXIS "
    COLOR FOR.GND,BACK.GND,BORDER
    LOCATE 9,22 : PRINT " PRESS (R) TO SELECT RIGHT AXIS "
  END IF

  IF IN$ = "R" THEN
    AXIS.STEP$ = MID$(AXIS.TEMP$,2,1)
    AXIS.BIAS$ = "R"
    COLOR 14,BACK.GND : LOCATE 9,22 : PRINT " PRESS (R) TO SELECT RIGHT AXIS "
    COLOR FOR.GND,BACK.GND,BORDER
    LOCATE 7,22 : PRINT " PRESS (L) TO SELECT LEFT AXIS "
  END IF
  IF IN$ = "+" OR IN$ = "-" THEN
    GOSUB STEP.MOT                          'RUN STEPPER ROUTINE
    A$ = INKEY$ : A$ = INKEY$ : A$ = INKEY$
  END IF

WEND
CLS
RETURN                    'RETURN TO PARENT

REM TITLE STEPPER MOTOR - JOG ROUTINE
REM PAGE

STEP.MOT:                 'STEP MOTOR - JOGGING ROUTINE

  IF IN.PREV$ = IN$ THEN                          'CHECK FOR SAME KEY
      KEY.CNT = KEY.CNT + 1
      IF KEY.CNT <= 2 THEN STEPS = 1
      IF KEY.CNT > 2 THEN STEPS = 4
      IF KEY.CNT > 4 THEN STEPS = 12
  ELSE
     IN.PREV$ = ""
     KEY.CNT = 0
     STEPS = 1
  END IF
    A$ = INKEY$

  IF IN$ = "+" THEN                       'CALCULATE FUTURE BIAS DISTANCE
       IF AXIS.BIAS$ = "L" THEN
         DIST.NEW.LEFT = DIST.LEFT + STEPS * STEP.SIZE
         DIST.BIAS = DIST.NEW.LEFT - DIST.RIGHT
       ELSE
         DIST.NEW.RIGHT = DIST.RIGHT + STEPS * STEP.SIZE
         DIST.BIAS = DIST.LEFT  - DIST.NEW.RIGHT
       END IF
  ELSE
       IF AXIS.BIAS$ = "L" THEN
         DIST.NEW.LEFT = DIST.LEFT - STEPS * STEP.SIZE
         DIST.BIAS = DIST.NEW.LEFT  - DIST.RIGHT
       ELSE
         DIST.NEW.RIGHT = DIST.RIGHT - STEPS * STEP.SIZE
         DIST.BIAS = DIST.LEFT  - DIST.NEW.RIGHT
       END IF
  END IF

     IF DIST.NEW.LEFT < FOLD.MIN AND DIST.NEW.RIGHT < FOLD.MIN THEN BEEP : GOTO
SMALL

  IF DIST.NEW.LEFT <= FOLD.MAX AND DIST.NEW.RIGHT <= FOLD.MAX  THEN


       IF ABS(DIST.BIAS) < .97 THEN                  'CHECK FOR BIAS LIMIT
         CALL OUT.CMD (" Y" + AXIS.STEP$,ERR.CODE)          'SELECT AXIS
         IF IN$ = "+" THEN DIR$ = "-" ELSE DIR$ = "+"
         NUM$ = MID$(STR$(STEPS),2,2)
```

```
          OUT$ = " " + DIR$ + " N" + NUM$ + " " +  " G"
          CALL OUT.CMD (OUT$,ERR.CODE)
          GOSUB READ.JOG.POS
        ELSE
         BEEP
        END IF
      BEEP
    END IF
  SMALL:
  RETURN

  REM PAGE

  READ.JOG.POS:
        REM - READ POSITION
        AXIS.STAT$ = MID$(AXIS.TEMP$,1,1)          'GET FIRST AXIS
        GOSUB READ.POS                             'GET VERIFY INFO
        DIST.LEFT = FOLD.MAX(FOLD) - DIST.READ     'GET LEFT AXIS DISTANCE

        AXIS.STAT$ = MID$(AXIS.TEMP$,2,1)
        GOSUB READ.POS                             'GET VERIFY INFO
        DIST.RIGHT = FOLD.MAX(FOLD) - DIST.READ    'GET RIGHT AXIS DISTANCE
        ROW.STAT = 25 : GOSUB DISP.STATUS          'DISPLAY STATUS ON LINE 25

        GOSUB READ.POS                             'READ POSITION
        GOSUB DISP.STATUS                          'DISPLAY STATUS
        RETURN

  REM TITLE SPECIAL CONTROLLER ROUTINES
  REM PAGE

  CONTR.CMD:                 'CUSTOM CONTROLLER COMMANDS
        CLS

  CONTR.1:
        LOCATE 5,10 : PRINT "ENTER COMMAND STRING:                ";
        LOCATE 5,30 : LINE INPUT OUT$
        IF OUT$ = "" THEN RETURN                   'RETURN TO MAIN MENU
        CALL OUT.CMD (OUT$,ERR.CODE)
        GOSUB READ.JOG.POS
        GOTO CONTR.1                               'LOOP AGAIN

  HOME:                      'OUTPUT THE GO TO HOME COMMAND
        BASE.SPEED$ = HOME.BASE.SPEED$ :  GOSUB INIT.MOT
        CLS : LOCATE 5,5 : PRINT "MOTORS ARE SEEKING (HOME);
        AXIS$ = AXIS.ACTIVE$                       'SET TO ACTIVE AXIS

  ' GOTO HOME.BYPASS

        OUT$ = " Y" + AXIS$ + " -  H1"
        CALL OUT.CMD (OUT$,ERR.CODE)

  HOME.BYPASS:

      FOLD = 1
      IF FOLD <= FOLD.ACTIVE THEN GOSUB READ.FOLD.POS
      FOLD = 2
      IF FOLD <= FOLD.ACTIVE THEN GOSUB READ.FOLD.POS
      FOLD = 3
      IF FOLD <= FOLD.ACTIVE THEN GOSUB READ.FOLD.POS
      FOLD = 4
      IF FOLD <= FOLD.ACTIVE THEN GOSUB READ.FOLD.POS

      OUT$ = " Y" + AXIS$ + " Z"                   'ZERO BOTH AXIS CONTROLLERS
      CALL OUT.CMD (OUT$,ERR.CODE)
      BASE.SPEED$ = RUN.BASE.SPEED$ :  GOSUB INIT.MOT
      RETURN

  REM TITLE INITIAL MOTOR ROUTINE
  REM PAGE
  INIT.MOT:                          'INITIALIZE MOTOR CONTROLLERS

        FOR I = 1 TO FOLD.ACTIVE * 2          'INIT. ONLY ACTIVE AXIS
```

```
        FACT$(I) = "2"
        ACCL$(I) = "25"
        DECL$(I) = "50"
        BASE$(I) = BASE.SPEED$
        MAX$(I) = "140"
        JOG$(I) = "10"
        DIR$(I) = "+"
        NUM$(I) = "0"
      NEXT I


FOR I = 1 TO FOLD.ACTIVE
        OUT1$ = " F" + FACT$(I) + " A" + ACCL$(I) + " D" + DECL$(I)
        OUT2$ = " B" + BASE$(I) + " M" +  MAX$(I) + " J" +  JOG$(I)
        OUT$ = OUT1$ + OUT2$
        IF I = 1 THEN AXIS$ = "12 "
         LOCATE 25,1 : PRINT "AXIS #1 - ";OUT$;
        IF I = 2 THEN AXIS$ = "34 "
         LOCATE 25,41 : PRINT "AXIS #2 - ";OUT$;
        IF I = 3 THEN AXIS$ = "56 "
         LOCATE 25,1 : PRINT "AXIS #3 - ";OUT$;
        IF I = 4 THEN AXIS$ = "78 "
         LOCATE 25,1 : PRINT "AXIS #4 - ";OUT$;

        CALL OUT.CMD (" Y" + AXIS$,ERR.CODE)
        CALL OUT.CMD (OUT$,ERR.CODE)
      NEXT I
      RETURN

REM TITLE FOLD POSITION ROUTINES
REM PAGE

MOVE.PAN:

      CLS : LOCATE 3,20
                                INPUT " ENTER FOLD PAN #1 POS. ",FOLDPAN1
      IF FOLD.ACTIVE > 1 THEN  INPUT " ENTER FOLD PAN #2 POS. ",FOLDPAN2
      IF FOLD.ACTIVE > 2 THEN  INPUT " ENTER FOLD PAN #3 POS. ",FOLDPAN3
      IF FOLD.ACTIVE > 3 THEN  INPUT " ENTER FOLD PAN #4 POS. ",FOLDPAN4

      GOSUB FOLD.POS
      RETURN


FOLD.POS:                 ' SEND MOTOR TO CERTIAN FOLD PAN POSITION ROUTINE

      LOCATE 5,20 : PRINT "MOVING ALL AXIS AT ONCE"
      AXIS$ = "12" : FOLD = 1 : FOLD.POS(FOLD) = FOLDPAN1
      GOSUB MOT.POS                              'SEND POSITION DATA

      AXIS$ = "34" : FOLD = 2 : FOLD.POS(FOLD) = FOLDPAN2
      GOSUB MOT.POS                              'SEND POSITION DATA

      AXIS$ = "56" : FOLD = 3 : FOLD.POS(FOLD) = FOLDPAN3
      GOSUB MOT.POS                              'SEND POSITION DATA

      AXIS$ = "78" : FOLD = 4 : FOLD.POS(FOLD) = FOLDPAN4
      GOSUB MOT.POS                              'SEND POSITION

     'SEND THE 'GO' COMMAND FOR ALL AXIS
      OUT$ = " Y" + AXIS.ACTIVE$ + "  G"         'BUILD AXIS 'GO' STRING
      CALL OUT.CMD (OUT$,ERR.CODE)
      DISP.DELAY = 0 : GOSUB READ.AXIS        'READ ALL AXIS


      RETURN

REM TITLE MOTOR POSTION ROUTINE
REM PAGE

MOT.POS:                 'SEND POSITION DATA - CONVERT FROM INCHES TO STEPS

 '*****
```

```
IF FOLD > FOLD.ACTIVE THEN RETURN                          'CHECK FOR LIMITED AXIS'S

'*****
      AXIS.LEFT$ = MID$(AXIS$,1,1)
      AXIS.RIGHT$ = MID$(AXIS$,2,1)
      POS.DES = FOLD.POS(FOLD)
      IF POS.DES >= .350 AND POS.DES <= FOLD.MAX(FOLD) THEN
         GOSUB READ.FOLD.POS

         POS.ABS = FOLD.MAX(FOLD) - POS.DES
         POS.STEP = INT(POS.ABS / STEP.SIZE)      'DO CONVERVSION

          POS.STEP$ = MID$(STR$(POS.STEP),2,5)
        '  LOCATE 23,1 : PRINT "POS.STEP$ =";POS.STEP$ : LINE INPUT A$

          OUT$ = " Y" + AXIS$
          CALL OUT.CMD (OUT$,ERR.CODE)

          OUT$ = "   P" + POS.STEP$  'BUILD POSITION STRING
        '  LOCATE 22,1 : PRINT "CMD = ";OUT$; : LINE INPUT A$
          CALL OUT.CMD (OUT$,ERR.CODE)

      ELSE
           BEEP : BEEP
           LOCATE 23,1 : PRINT "FOLD PAN POSITION IS OUT OF RANGE - PRESS (RETUR
N) TO CONTINUE ";
           LINE INPUT; A$

      END IF
          RETURN


REM TITLE STORE PROGRAM TO CONTROLLER
REM PAGE

CONT.PRG:

    GOSUB INIT.MOT                          'INITIALIZE THE CONTROLLERS

    PROG$ = "B80,-H1,B10,P1200,G,X1000,P2000,G,P3000,G,P2000,L3,13,B80,-H1,0,0"
    PROG.SIZE = LEN(PROG$)
    PROG.SIZE$ = MID$(STR$(PROG.SIZE),2,80)
    OUT$ = " Y12"                           'SELECT AXIS 1 AND 2
    CALL OUT.CMD (OUT$,ERR.CODE)
    OUT$ = " E0," + PROG.SIZE$              'SEND BUFFER START AND LENGTH
    CALL OUT.CMD (OUT$,ERR.CODE)
    CLS
    LOCATE 5,5 : PRINT "PROG SIZE = ";PROG.SIZE
    IF PROG.SIZE > 74 THEN
       PRINT "PROGRAM HAS MORE THAN 74 CHARACTERS IN IT - PRESS RETURN "
       LINE INPUT A$
       RETURN
    END IF
    CALL OUT.CMD (PROG$,ERR.CODE)           'SEND PROGRAM STRING
    OUT$ = " R0"                            'START THE PROGRAM
    CALL OUT.CMD (OUT$,ERR.CODE)
    CLS : LOCATE 6,5 : PRINT "THE PROGRAM HAS STARTED "
    BEEP

   RETURN


REM TITLE SEQUENCE MENU
REM PAGE

SEQ.MENU:                   'RUN PROGRAMMED SEQUENCE

        CLS
        LOCATE 5,15 : PRINT "1 - ENTER FOLD PAN POSITION"
        LOCATE 7,15 : PRINT "2 - RUN SEQUENCE"
        LOCATE 23,15 : PRINT "PRESS (RETURN) TO RETURN TO MAIN MENU"
SEQ.LOOP:
        IN$ = INKEY$
```

```
        IF IN$ = CR$ THEN RETURN                    'RETURN TO MAIN MENU
        IF IN$ < "1" OR IN$ > "2" THEN GOTO SEQ.LOOP
        ON VAL(IN$) GOSUB ENT.SEQ,RUN.SEQ

        GOTO SEQ.MENU


ENT.SEQ:

FOLD.POS  = 1
I = 1
WHILE FOLD.POS > 0
  CLS
  LOCATE 3,5 : PRINT "FOR SEQUENCE NUMBER ";I;
 'LOCATE 5,5 : INPUT "ENTER FOLD PAN NUMBER (1 TO 4) ";FOLD.PAN
  LOCATE 7,5 : INPUT "ENTER FOLD PAN POSITION ";FOLD.POS
  SEQ.POS(I) = FOLD.POS
  I = I + 1
WEND
RETURN


RUN.SEQ:

CLS : INPUT "USE SEQUENCE Y OR N ";SEQ.PAUSE$

I = 1
FOLDPAN1 = 1
CLS : LOCATE 5,1
WHILE FOLDPAN1 > 0
  FOLDPAN1 = SEQ.POS(I)
  IF FOLDPAN1 < 0 THEN RETURN
  PRINT "SEQUENCE NUMBER =";I," FOLD POSITION = ";FOLDPAN1
  IF SEQ.PAUSE$ = "Y" THEN BEEP :LINE INPUT A$
  GOSUB FOLD.POS
I = I + 1
WEND
RETURN

REM TITLE READ AXIS ROUTINE
REM PAGE

READ.AXIS:                  ' READ POSITION OF EACH AXIS

    FOR FOLD = 1 TO FOLD.ACTIVE
      GOSUB READ.FOLD.POS
    NEXT FOLD

'    LOCATE 20,1
'          PRINT "AXIS      1         2         3         4         5         6
 7         8 "
'    FMT.STEP$ = "STEPS   ####      ####      ####      ####      ####      ####
####      ####"
'    FMT.DIST$ = "INCHES ###.###  ###.###  ###.###  ###.###  ###.###  ###.###  #
##.###  ###.###"
'    PRINT USING FMT.STEP$;STEPS(1),STEPS(2),STEPS(3),STEPS(4),STEPS(5),STEPS(6)
,STEPS(7),STEPS(8)
'    PRINT USING FMT.DIST$;DIST(1),DIST(2),DIST(3),DIST(4),DIST(5),DIST(6),DIST(
7),DIST(8):

'    START = TIMER
'    WHILE START + DISP.DELAY > TIMER  AND INKEY$ <> CR$   'WAIT
'    WEND
'    DISP.DELAY = 2                            'RESET TO 2 SECOND DELAY
    RETURN


READ.FOLD.POS:

          AXIS.RIGHT = FOLD * 2
          AXIS.LEFT = AXIS.RIGHT - 1

          AXIS.STAT$ = MID$(STR$(AXIS.LEFT),2,1)          'GET LEFT AXIS
```

```
GOSUB READ.POS                                          'GET VERIFY INFO
POS.LEFT = STEP.READ                                    'GET STEPPER POS.
DIST.LEFT = FOLD.MAX(FOLD) - DIST.READ                  'GET LEFT AXIS DIST.
DIST(AXIS.LEFT) = DIST.LEFT


AXIS.STAT$ = MID$(STR$(AXIS.RIGHT),2,1)
GOSUB READ.POS                                          'GET VERIFY INFO
POS.RIGHT = STEP.READ                                   'GET STEPPER POS.
DIST.RIGHT = FOLD.MAX(FOLD) - DIST.READ                 'GET RIGHT AXIS DIST.
DIST(AXIS.RIGHT) = DIST.RIGHT

RETURN


REM TITLE INITIALIZE VARIABLES AND COM PORT
REM PAGE

SET.VAR:                    'SET PROGRAM VARIABLES DEFAULTS

   CLS
   X = 0
   CALL BOX(X+2,X+5,X+20,X+75,X+ 5,FOR.GND)
   LOCATE 3,30 : PRINT "SET PROGRAM VARIABLE"
   LOCATE 7,15 : PRINT "ENABLE PAUSE Y/N ";
   CALL ENT.STR(PAUSE$)
   LOCATE 8,15 : PRINT "ENTER STEP SIZE IN INCHES ";
   CALL ENT.VAL (STEP.SIZE)
   LOCATE 9,15 : PRINT "ENTER NUMBER OF ACTIVE FOLDPANS ";
   CALL ENT.VAL (FOLD.ACTIVE)
   LOCATE 10,15 : PRINT "ENTER FOLD PAN 1 MAX ";
   CALL ENT.VAL (FOLD.MAX(1))
   LOCATE 11,15 : PRINT "ENTER FOLD PAN 2 MAX ";
   CALL ENT.VAL (FOLD.MAX(2))
   LOCATE 12,15 : PRINT "ENTER FOLD PAN 3 MAX ";
   CALL ENT.VAL (FOLD.MAX(3))
   LOCATE 13,15 : PRINT "ENTER FOLD PAN 4 MAX ";
   CALL ENT.VAL (FOLD.MAX(4))
   RETURN


SUB ENT.VAL (VALUE) STATIC                  'TEST FOR A NEW INPUT
    PRINT VALUE;"  ";
    LINE INPUT; A$
    IF A$ <> "" THEN VALUE = VAL(A$)
END SUB


SUB ENT.STR (VAR.STR$) STATIC
    PRINT VAR.STR$;"  ";
    LINE INPUT; A$
    IF A$ <> "" THEN VAR.STR$ = A$
END SUB

REM TITLE ERROR HANDLING ROUTINE
REM PAGE

ERROR.ROUT:

  X = 0
  CALL BOX(X+13,X+5,X+22,X+75,X+ 0,FOR.GND)
    BEEP
    LOCATE 14,10 : PRINT "********** PROGRAM RUN TIME ERROR **********";
    BEEP
  IF ERR = 24 AND ERL = 100 THEN
    LOCATE 16,10 : PRINT "COMMUNICATION TIME OUT WITH THE CONTROLLER";
    LOCATE 17,10 : PRINT "CHECK THE CABLES TO THE CONTROLLER ";
  ELSE
    LOCATE 17,10 : PRINT "ERROR NUMBER ";ERR; " IN LINE ";ERL ;
  END IF

  LOCATE 19,10 : PRINT "PRESS (R) TO RETRY OR ";
  LOCATE 20,10 : PRINT "PRESS (RETURN) TO GO TO MAIN MENU";
```

```
IN$ = ""
WHILE IN$ <> CR$ AND IN$ <> "R"
 IN$ = INKEY$
WEND
IF IN$ = CR$ THEN RESUME START.1
IF IN$ = "R" THEN CLS : RESUME

'END OF ERROR ROUTINE
```

Having described the invention in detail and by reference to preferred embodiments thereof, it will be apparent that modifications and variations are possible without departing from the scope of the invention defined in the appended claims.

What is claimed is:

1. An automatic fold-pan assembly comprising, in combination:

(a) at least one upper plate and at least one lower plate defining a space therebetween having a sheet-entrance mouth at one end and an opposite end at the other end thereof;

(b) at least one fold-controlling paper stop disposed in said space and substantially infinitely adjustably positionable in the plane of said space toward and away from said sheet-entrance mouth to substantially any position between said sheet-entrance mouth and proximal to said opposite end;

(c) means for positioning said paper stop relative to said sheet entrance mouth, said positioning means including:

(i) control means for automatically determining the proper position of said paper stop relative to said sheet-entrance mouth said control means including computer means and keyboard-entry means for manually entering input information into said computer means about sheet length and fold type and whether said fold-pan assembly is to be used for folding or is to be bypassed; and, for generating signals corresponding to said proper position; and, (ii) motor drive means including a stepper motor operative in response to said signals from said control means to automatically move said paper stop to said proper position.

2. The assembly of claim 1 in which said control means includes means for initializing the position of said paper stop upon start up of said assembly.

3. An automatic fold-pan assembly comprising, in combination:

(a) at least one upper plate and at least one lower plate defining a space therebetween and having a sheet-entrance mouth at one end thereof;

(b) at least one fold-controlling paper stop disposed in said space and toward and away from said sheet-entrance mouth; drive means responsive to said control means to move said paper stop to said position;

(c) means for positioning said paper stop relative to said sheet-entrance mouth, said positioning means including control means for automatically determining the proper position of said paper stop relative to said sheet-entrance mouth; drive means responsive to said control means to move said paper stop to said position; and, wherein said control means initializes the position of said proper stop upon startup of said assembly and includes a limit switch to detect the end of travel of said paper stop during initialization.

4. An automatic fold-pan assembly comprising, in combination:

(a) at least one upper plate and at least one lower plate defining a space therebetween having a sheet-entrance mouth at one end and an opposite end at the other end thereof;

(b) a plurality of fold-controlling paper stops spaced across said upper and lower plates, said paper stops being interconnected to move in unison and substantially infinitely adjustably positionable in the plane of said space toward and away from said sheet-entrance mouth to substantially any position between said sheet-entrance mouth and proximal to said opposite end;

(c) at least one of said plurality of paper stops being removable to accommodate the folding of sheets having tabs depending therefrom;

(d) means for positioning said paper stop relative to said sheet entrance mouth, said positioning means incuding:

(i) control means for automatically determining the proper position of said paper stop relative to said sheet-entrance mouth said control means including computer means and keyboard-entry means for manually entering input information into said computer means about sheet length and fold type and whether said fold-pan assembly is to be used for folding or is to be bypassed; and, for generating signals corresponding to said proper position; and, (ii) motor drive means including a stepper motor operative in response to said signals from said control means to automatically move said paper stop to said proper position.

* * * * *